US006164728A

United States Patent [19]

Sollami

[11] Patent Number: 6,164,728

[45] Date of Patent: Dec. 26, 2000

[54] TOOL MOUNTING ASSEMBLY WITH TUNGSTEN CARBIDE INSERT

[75] Inventor: Phillip A. Sollami, Herrin, Ill.

[73] Assignee: The Sollami Company, Herrin, Ill.

[21] Appl. No.: 09/121,726

[22] Filed: Jul. 24, 1998

[51] Int. Cl.[7] ..... E21C 35/18

[52] U.S. Cl. ..... 299/104; 299/106

[58] Field of Search ..... 299/111, 113, 299/104, 105, 106

[56] References Cited

U.S. PATENT DOCUMENTS

| | | | |
|---|---|---|---|
| 3,512,838 | 5/1970 | Kniff | 299/104 |
| 4,084,856 | 4/1978 | Emmerich et al. . | |
| 4,561,698 | 12/1985 | Beebe . | |
| 4,660,890 | 4/1987 | Mills . | |
| 4,844,550 | 7/1989 | Beebe | 299/107 |
| 4,932,723 | 6/1990 | Mills . | |
| 5,702,160 | 12/1997 | Levankovskii et al. | 299/113 |
| 5,931,542 | 8/1999 | Britzke et al. | 299/104 |

FOREIGN PATENT DOCUMENTS

| | | |
|---|---|---|
| 4202961A1 | 8/1993 | Germany . |
| 1362821A1 | 12/1987 | U.S.S.R. . |
| 2004315A | 3/1979 | United Kingdom . |

OTHER PUBLICATIONS

"Kennametal Conical Coal–Tooling Systems", Kennametal, Jun. 1989.

*Primary Examiner*—David Bagnell
*Assistant Examiner*—Sunil Singh
*Attorney, Agent, or Firm*—Robert L. Marsh

[57] ABSTRACT

A tool mounting block for a cutting machine has a forward surface and an aperture in the forward surface for receiving the cylindrical mounting portion of a tool. To extend the useful life of the mounting block, an annular insert is fitted around the aperture such that the forward surface of the insert provides a bearing surface to facilitate rotation of the tool within the mounting block.

1 Claim, 3 Drawing Sheets

TOOL MOUNTING ASSEMBLY WITH TUNGSTEN CARBIDE INSERT

The present invention relates to rotatable mountings for cutting tools and in particular to rotatable mountings for cutting tools used for cutting hard surfaces and having tungsten carbide tips.

BACKGROUND OF THE INVENTION

Machines are available for cutting hard surfaces such as concrete and asphalt. To cut such hard surfaces, a wheel is rotated about its axis and cutting tools mounted on the wheel are applied against the surface and each tool removes a small portion of hardened material thereby advancing the cut.

To maximize the useful life of such cutting tools, the tools are rotatably mounted about a longitudinal axis and have a cylindrical mounting portion rotatably fitted into a cylindrical aperture on a mounting block. Force is applied from the mounting block on the wheel against a rearward surface of an annular flange on the tool which rests upon a forward surface of the mounting block.

The body of the tool to which the tungsten carbide cutting tip is attached and the tool mounting block into which the cylindrical mounting portion of the tool is fitted are made of cold formed or forged steel which is much softer than the tungsten carbide cutting tip. As the machine cuts hard surfaces such as asphalt or concrete, fragments of the broken surface are forced across the tapered forward portion of the tool and around the forward and side portions of the mounting block causing wear or wash away of the material which makes up both the tool and the mounting block. After a substantial portion of the forward end of the tool has been worn away, the tool must be replaced. Similarly, after a substantial portion of the body of the mounting block has been washed away, the tool mounting block must also be replaced.

The rotation of the tool within the block occurs as a result of an uneven application of forces against the tool as it is applied to the hardened surface and, therefore, the mated annular surfaces on the block and on the tool, which transfer force from the block to the tool, also serves as a bearing surface for the rotation of the tool within the block. Over a period of use, particles of hardened material broken up by the tool work along the forward surface of the mounting block and under the rearward surface of the flange causing the mated surfaces to become irregular and thereby increasing the friction between the surfaces. The increased friction reduces the rotatability of the tool within the block. A tool which does not rotate within the mounting block will wear unevenly, thereby substantially reducing its useful life.

In recent years, the annular flanges behind the forward cutting ends of tools have been made larger in diameter to provide additional protection to the mounting block such that the body of the mounting block will remain intact much longer than the body of the tool retained therein. Although the presence of the enlarged flange on such tools has served to protect the body of such mounting blocks against wash away, the particles of hardened material nonetheless work their way between the abutting surfaces of the mounting block and the tool and cause the forward surfaces of the mounting block and the surface of the cylindrical aperture extending through the mounting block to become worn. As a result of the wear on these two surfaces, a replacement tool inserted in the mounting block will not be snugly retained in the aperture, nor will the replacement tool rotate freely therein. As a result of the foregoing, when a tool is inserted into a previously used mounting block, the replacement tool frequently has a useful life which is much shorter than that of the original tool.

It would be desirable, therefore, to provide a mounting block for which the critical surfaces required to rotatably retain a tool therein will not become so worn as to be unusable during the useful life of a single tool.

SUMMARY OF THE INVENTION

Briefly, the present invention is embodied in a tool mounting block having a forward surface and an attachment portion whereby the mounting block is attachable to a cutting machine. The tool block has a forward surface and an aperture extending through the body of the block and an opening in the forward surface. A countersink is provided in the forward surface around the aperture and an annular insert is fitted within the countersink. The annular insert has a central opening axially aligned with the axis of the cylindrical aperture in the mounting block and has a forward surface, at least a portion of which is coplanar with a portion of the forward surface of the mounting block. In the preferred embodiment, the annular insert is made of tungsten carbide and is bonded into the countersink in the mounting block with a suitable bonding material such as a braze.

A tool having a generally tapered body with a forward cutting end and a tungsten carbide tip at the forward end thereof has an annular flange positioned rearward of the tapered body and a cylindrical mounting portion axially aligned behind the forward cutting end of the flange. The cylindrical mounting portion of the tool is rotatably fitted into the cylindrical aperture of the mounting block to permit rotation of the tool. A rearward surface of the annular flange, therefore, abuts against the forward surface of the annular insert. Since the tungsten carbide of the annular insert is much harder than the steel from which the body of the tool is made, the steel of the tool becomes worn away by particles of hard material which work their way between the abutting surfaces of the annular insert and the tool while the surfaces of the tungsten carbide insert suffer very little wear. Typically, the steel of the tool is worn away approximately ten times faster than the tungsten carbide of the insert is worn away.

After a tool mounted in such a block has become worn, the tool can be removed and the forward surface of the tungsten carbide annular insert will not be gouged or damaged so as to cause a substantial increase in the resistance to rotation when a new tool is inserted into the block. Similarly, a cylindrical inner surface of the annular insert will not have become worn away as a result of particles of hardened material working their way between the parts and when the cylindrical mounting portion of the replacement tool is inserted therein, it will be snugly retained therein. In addition to the above, the coefficient of friction between two surfaces where one is steel and one is tungsten carbide is less than the coefficient of friction between two surfaces where both are steel. As a result, a replacement tool fitted into a mounting block incorporating the present invention will have a useful life which is substantially the same as the useful life of the original tool.

In another embodiment of the invention, the aperture into which the tool is received extends to a rear surface of the mounting block and a counterbore is provided in the rear surface around the aperture. A second annular insert of tungsten carbide is provided in the counterbore in the rear surface such that a tungsten carbide ring is provided around both the forward and rearward ends of the aperture to ensure that both ends thereof are wear resistant.

BRIEF DESCRIPTION OF THE DRAWINGS

A better and more complete understanding of the present invention will be had after a reading of the following detailed description taken in conjunction with the drawings wherein.

DETAILED DESCRIPTION OF THE PREFERRED EMBODIMENT

Figure 1:
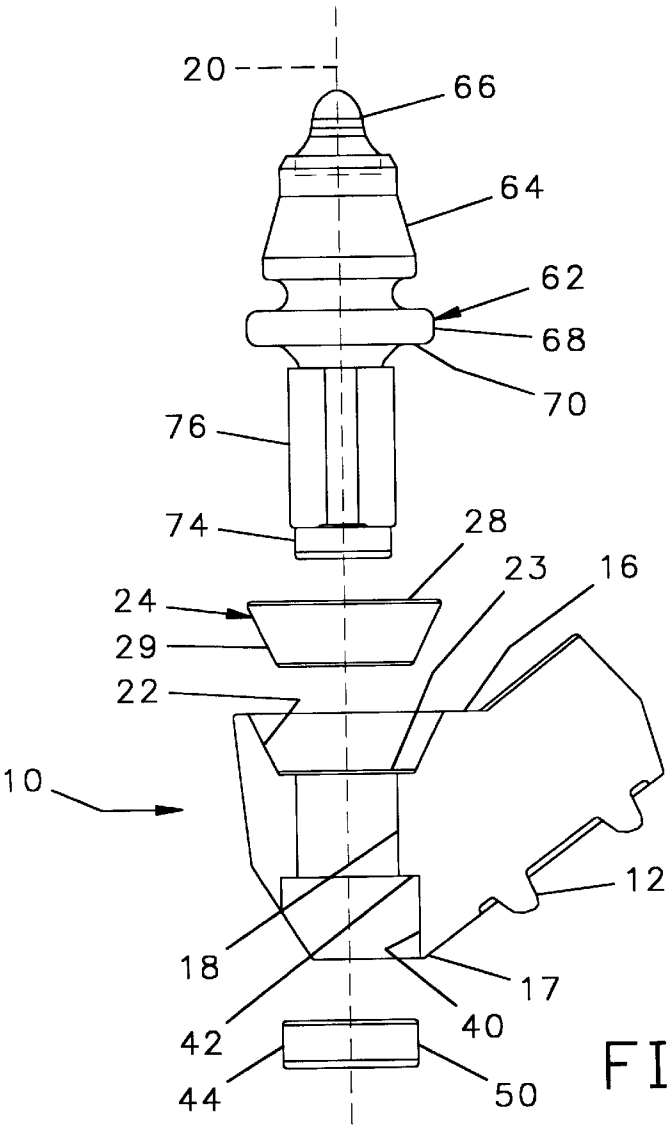
FIG. 1 is an exploded view of a tool mount having inserts therein according to the present invention and having a tool mounted therein with the mounting block shown in cross section.
Figure 2:
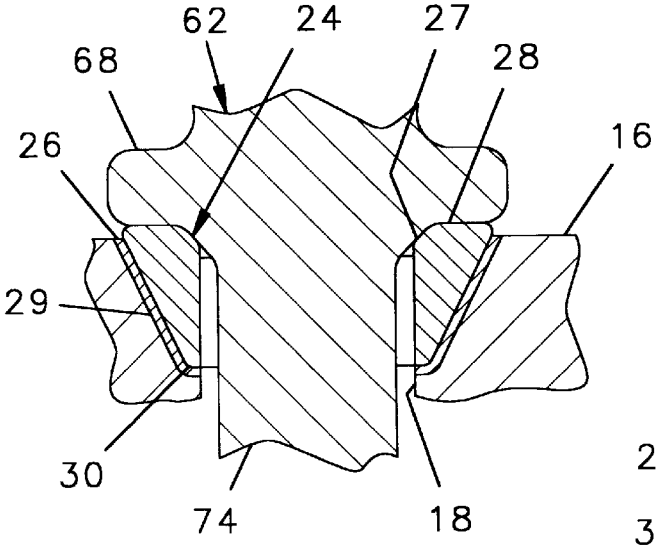
FIG. 2 is an enlarged fragmentary cross sectional view of the assembled forward insert in the mounting block shown in FIG. 1.

Referring to FIGS. 1, and 2, a tool mounting block 10 in accordance with the present invention has a forged formed body, one end 12 of which is adapted to fit against a machine (not shown) and retained to the machine by a weldment (not shown) or some other means of attachment.

The mounting block 10 has a forward surface 16 and a rearward surface 17, and extending through the body of the block 10) is a cylindrical bore 18, the axis 20 of which is perpendicular to the forward surface 16. Around the opening of the bore 18 in the forward surface 16 is a frustoconical countersink 22 having a bottom surface 23 and fitted into the countersink 22 is a unitary annular insert 24, which in the preferred embodiment is made of tungsten carbide. The insert 24 is retained within the countersink 22 by a suitable attachment means such as a braze material 26. For the purposes of this discussion, the term "countersink" encompasses all configurations of a countersink, including a configuration in which the walls thereof are cylindrical and commonly referred to as a counterbore.

Figure 3:
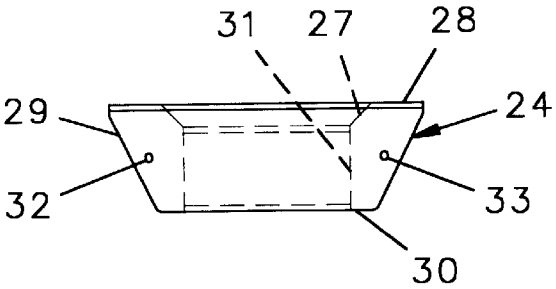
FIG. 3 is an enlarged side view of the forward insert shown in FIG. 1 with the inner portion thereof shown in phantom lines.
Figure 4:
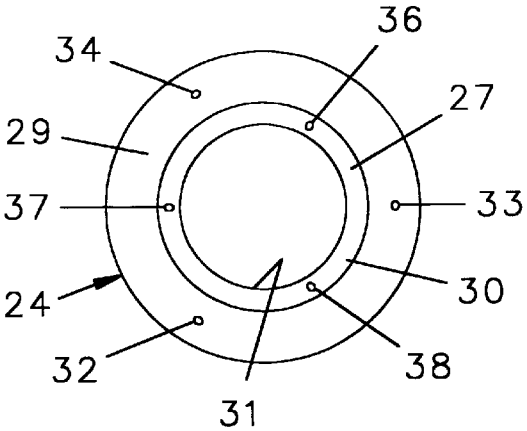
FIG. 4 is a bottom view of the insert shown in FIG. 3.

Referring to FIGS. 3 and 4, the annular insert 24 has a generally planar annular forward surface 28 which is substantially coplanar with the forward surface 16 of the mounting block 10. The insert 24 further has a frustoconical outer surface 29, a planar rearward surface 30, and a cylindrical inner wall 31 coaxial with axis 20 and having a diameter which is equal to the inner diameter of the bore 18 of the mounting block. A frustoconical taper 27 breaks the intersection between the forward surface 28 and the cylindrical inner wall 31. A first plurality of dimples 32, 33, 34 are spaced around the outer surface 29 of the insert 24 and a second plurality of dimples 36, 37, 38 are spaced around the rearward surface 30 thereof. The dimples 32, 33, 34, 36, 37, 38 space the surfaces 29, 30 of the insert 24 from the surfaces 22, 23 of the mounting block 10 to permit braze material to flow therebetween. Preferably, the dimples will space the surfaces of the insert 24 a distance of from 0.004 to 0.012 inch from the surfaces of the block 10 to allow a liquefied braze material to flow between the parts. When the insert 24 is brazed within the countersink 22, the brazing material 26 binds to the insert 24 along the planar lower surface 30 of the insert and around the outer surface 29 thereof so that the insert 24 will be securely retained to the walls of the countersink 22 and the bottom surface 23.

The tungsten carbide from which the insert 24 is made is very expensive and it is desirable, therefore, to manufacture parts made of this material so as to consume as little of this material as possible to thereby minimize the cost of manufacture. As can be seen in FIG. 2, the cross sectional shape of the insert 24 has been chosen so as to employ a minimum amount of tungsten carbide therein.

The frustoconical shape of the surface 29 protects the braze 26 binding the insert 24 into the countersink 22 from the effects of wash away of the metal of the tool body 10, and also provides a larger surface area for receiving the braze 26.

Figure 5:
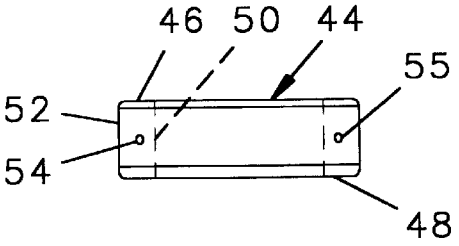
FIG. 5 is an enlarged side view of the second insert shown in FIG. 1 with the inner portion thereof shown in phantom lines.
Figure 6:
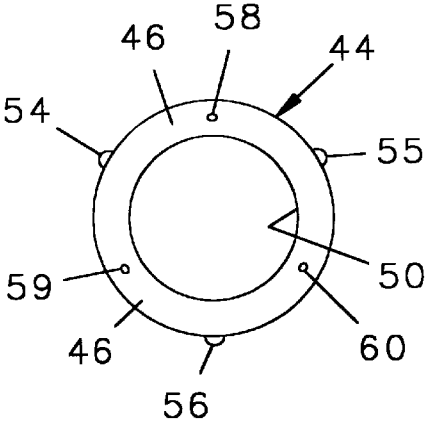
FIG. 6 is a top view of the insert shown in FIG. 5.

Referring to FIGS. 1, 5 and 6, around the opening of the bore 18 in the rearward surface 17 is a counterbore with cylindrical sidewalls 40 and a planar inner surface 42, into which is fitted a second annular insert 44. The second insert has a planar forward surface 46, a planar rearward surface 48, and cylindrical inner and outer walls 50, 52, respectively. The inner wall 50 has a diameter equal to diameters of bore 18 and inner diameter 31, and the outer wall 52 has a diameter which is a little less than the inner diameter of cylindrical side wall 40. The second insert 44 also has a first set of dimples 54, 55, 56 spaced around the outer wall 52 thereof and a second set of dimples 58, 59, 60 spaced around the forward surface 46 thereof for spacing the wall 52 of the insert 44 from the wall 40 of the counterbore and the forward surface 46 from the inner surface 42 for permitting a braze material to flow therebetween.

Fitted into the bore 18, 31 of the mounting block 10 and the insert 24 is a rotatable tool 62 having a generally tapered forward cutting end 64 which has a hardened tungsten carbide tip 66 at the forwardmost end thereof. Rearward of the forward cutting end 64 is a radial flange 68 having a rearward surface 70 which abuts against the forward surface 28 of the annular insert 24. The tool 62 is generally symmetric about the longitudinal axis 20 of the bore 18 and axially aligned behind the forward cutting end 64 and the radial flange 68 is a cylindrical mounting portion 74. The mounting portion 74 rotatably fits within the cylindrical openings 18, 31, 50 of the block 10 and the inserts 24, 44 and has a sleeve 76 around the circumference thereof to retain the mounting portion 74 within the bore 18 of the block 10.

The tool 62 is rotatable within the openings 18, 31, 50 of the block 10 and the annular inserts 24, 44 respectively, but the inner diameters of the bores 18, 31, 50 are only a little larger than the outer diameter of the mounting portion 74 such that even though the tool is rotatable within the bores 18, 31, 50 it is generally snugly retained within the apertures so as not to significantly wobble relative to the mounting block 10. As can best be seen in FIG. 1, the force of the machine is applied through the mounting block 10 across the forward surface 28 of the annular insert 24 to the rearward surface 70 of the tool 62 and, therefore, strong forces are applied against the abutting surfaces 28, 70 of the annular insert 24 and tool 62, respectively.

Preferably, the radial flange 68 of the tool 62 has a diameter which is larger than the outer diameter of the annular insert 24 to thereby protect the forward surface 28 thereof from damage by hard particles of material which have been removed by the cutting tip 66 and move along the length of the cutting end 64. It should be appreciated that the radial flanges 68 of all tools do not have large enough outer diameters to protect the forward surfaces 16 of the mounting block 10 against wash away. The first insert 24, however, has an outer diameter at the forward surface 28 which is sufficiently large to protect the body of the mounting block 10 against wash away. During use of the tool 62, some of the particles of loosened material work between the surfaces 28, 70 of the cylindrical insert 24 and radial flange 68, respectively, and into the openings 31, 50 of the inserts 24, 44 and the bore 18 of the block 10.

When the tool 62 is fitted into mounting block 10, the forward end of the mounting portion 74 of the tool 62 rotates within the cylindrical opening 31 of the first insert 24 and the rearward end of the mounting portion 74 rotates within the cylindrical opening 50 of the second insert 44.

In prior art tools and mountings, particles of hardened material which worked between the abutting surfaces of the tool and the mounting block and around the inner surface of the bore within the block caused the forward surface of the block to become worn and caused the bore of the block to become enlarged and no longer cylindrical. As a result of such wear, when the original tool was discarded and a replacement tool inserted into such prior art blocks, the damage to the forward surfaces thereof inhibited the rotation of the replacement tool. Similarly, because of the damage to the inner surfaces of the bore thereof, the mounting portion of the replacement tool would not fit tightly within the bore such that the replacement tool would wobble within the mounting. The wobbling of the replacement tool within its mounting and its inability to freely rotate within the mounting resulted in the rapid deterioration of the replacement tool.

A mounting block 10 in accordance with the present invention, however, will not be subjected to as much wear from particles of hardened material which work their way between the surfaces 28, 70 of the annular insert 24 and tool 62 as did prior art blocks because the tungsten carbide inserts are much harder than the steel of the tool body 62. The hard particles thereby cause damage to the rearward surface 70 of the tool 62 and to the mounting portion 74 of the tool, but very little damage to the forward surface 28 of the insert 24 or the cylindrical apertures 31, 50 of the inserts 24, 44. Furthermore, the large diameter of the flange 68 of the tool 62 will protect the body of the mounting block 10 from wash away such that the block 10 will have a useful life which is substantially longer than the life of the tools 62. Accordingly, when a tool 62 has become worn, the tool can be removed from the mounting block 10 and a new tool 62 inserted therein. The new tool will be snugly retained within the cylindrical apertures 31, 50 of the annular inserts 24, 44 and the forward surface 28 of the annular insert 24 will be substantially smooth so as to readily permit rotation of the replacement tool 62.

In addition to increasing the overall life of the mounting block 10, the hardened forward surface 28 of the insert 24 has a lower coefficient of friction than the steel of the forward surfaces of prior art mounting blocks. The insert 24, therefore, also acts as an improved bearing to facilitate rotation of the tool 62.

Figure 8:
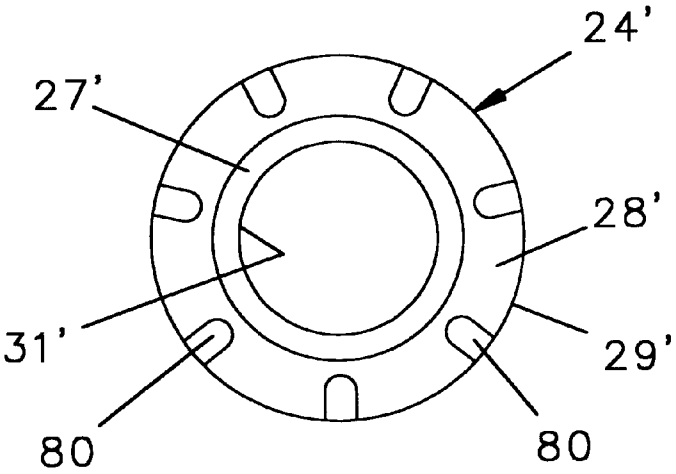
FIG. 8 is a top view of the insert shown in FIG. 7.
Figure 7:
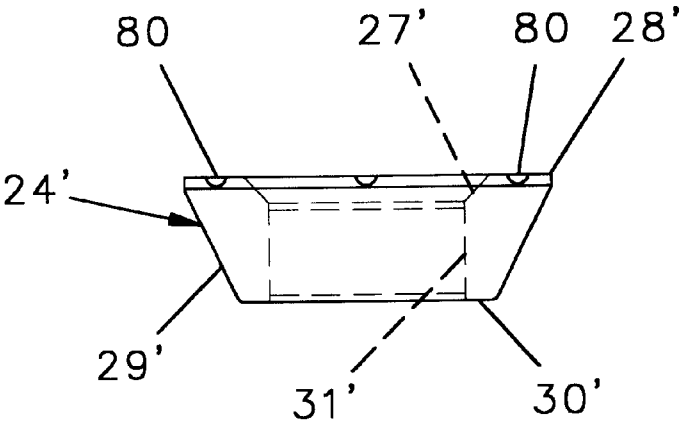
FIG. 7 is an enlarged side view of a second embodiment of the forward insert.

Referring to FIGS. 7 and 8, a second embodiment of a first insert 24' is similar to the first embodiment, and like portions bear like indicia numbers except that they are primed. Specifically, insert 24' has a planar forward surface 28', a frustoconical outer surface 29', a planar rear surface 30', a cylindrical inner wall 31', and a taper 27' joining the forward surface 28' to the inner wall 31'. In addition to the above, insert 24' has a plurality of spaced radially directed grooves 80—80 in the forward surface 28' with each groove 80 extending to the outer surface 29' but not extending to the tapered surface 27'.

The grooves 80—80 provide clean out channels into which particles of material which work between the forward surface 28' and the rearward surface 70 of the flange 68 will be ejected out as the tool 24 rotates within the mounting block 10. The grooves 80—80 also reduce the surface area of surface 28', thereby reducing the friction between the forward surface 28' and the rearward surface 70, and thereby facilitate rotation of the tool 62.

While two embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed is:

1. A tool mounting for receiving a tool comprising a tool mounting block having a forward surface and an attachment portion, said attachment portion for attachment to a machine, said tool mounting block having a cylindrical aperture therein, said aperture having an axis and having an opening in said forward surface, said forward surface having a countersink around said aperture, a unitary annular insert in said countersink, said annular insert having a cylindrical central opening axially aligned with said axis of said cylindrical aperture of said mounting block, said annular insert made of tungsten carbide, attachment means between said mounting block and said annular insert for attaching said insert within said countersink of said mounting block, and said insert having a forward surface, and said forward surface of said insert having at least one groove, said groove extending to an outer surface of said insert.

* * * * *